US006962479B2

(12) United States Patent
Hubbard

(10) Patent No.: US 6,962,479 B2
(45) Date of Patent: Nov. 8, 2005

(54) COMPOUND CENTRIFUGAL AND SCREW COMPRESSOR

(76) Inventor: Adrian Alexander Hubbard, 39 Egerton Road, Bushbury, Wolverhampton, West Midlands (GB) WV10 8AU ( * ) Notice: Subject to any disclaimer, the term of this patent is extended or adjusted under 35 U.S.C. 154(b) by 66 days.

(21) Appl. No.: 10/783,013

(22) Filed: Feb. 23, 2004

(65) Prior Publication Data

US 2004/0208740 A1 Oct. 21, 2004

(30) Foreign Application Priority Data

Apr. 16, 2003 (GB) ..... 0308774

(51) Int. Cl.[7] ..... F04D 3/02

(52) U.S. Cl. ..... 415/72; 416/177

(58) Field of Search ..... 415/72–74, 218.1; 416/175–177, 203

(56) References Cited

U.S. PATENT DOCUMENTS

| | | | | |
|---|---|---|---|---|
| 86,264 | A * | 1/1869 | White et al. | 415/159 |
| 2,483,335 | A * | 9/1949 | Davis | 415/210.1 |
| 5,549,451 | A * | 8/1996 | Lyda, Jr. | 415/218.1 |
| 6,138,757 | A * | 10/2000 | Latos et al. | 166/265 |
| 6,790,016 | B2 * | 9/2004 | Chiang | 417/423.1 |

* cited by examiner

*Primary Examiner*—Edward K. Look
*Assistant Examiner*—Devin Hanan

(57) ABSTRACT

A compound centrifugal and screw compressor comprising two separate sections. The first section is a conventional centrifugal compressor body 2 with a plurality of radial vanes 3 and 4 on the front face. The second section of the compressor is a screw type compressor with a plurality of helical vanes 6 mounted on a conical screw body 5; the helical vanes 6 are lesser in number than the short radial vanes 4 and the same in number as the long radial vanes 3, typically one quarter to one third, and mate up with longer radial vanes 3 at the extremity of the centrifugal 2 compressor rim. The conical screw body 5 is the same diameter as the outer rim of the centrifugal compressor and reduces down at the output end. The helical vanes each complete one full turn.

4 Claims, 6 Drawing Sheets

COMPOUND CENTRIFUGAL AND SCREW COMPRESSOR

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

Present technology for gas turbines is an axial flow compressor, comprising many individual parts and having great complexity and weight. Alternatively a centrifugal compressor can be employed, which is much simpler and lighter than an axial flow compressor, but has a much lower pressure ratio. The invention disclosed herein sets out to provide simplicity and high pressure ratios in the same compressor. Also this compressor can be used for a great many other applications.

BRIEF SUMMARY OF THE INVENTION

According to the present invention there is provided a compound centrifugal and screw compressor comprising two separate sections. The first section is a conventional centrifugal compressor body with a plurality of radial vanes on the front face. The second section of the compressor is a screw type compressor with a plurality of helical vanes mounted on a conical screw body; the helical vanes are lesser in number than the radial vanes, typically one quarter to one third, and mate up with longer radial vanes at the extremity of the centrifugal compressor rim. The conical screw body is the same diameter as the outer rim of the centrifugal compressor and reduces down at the output end. The helical vanes each complete one full turn. The compressor is manufactured in two separate parts only, each part being in one piece; the two parts are mounted on a driven shaft. The whole compressor is enclosed in a casing with an inlet at the centrifuge end and an exhaust at the smaller end of the screw body. The casing ducts the compressed air within. This compressor is suitable for gas turbines, turbochargers, superchargers and the like.

BRIEF DESCRIPTION OF THE SEVERAL VEIWS OF THE DRAWING

DETAILED DESCRIPTION OF THE INVENTION

Figure 1:
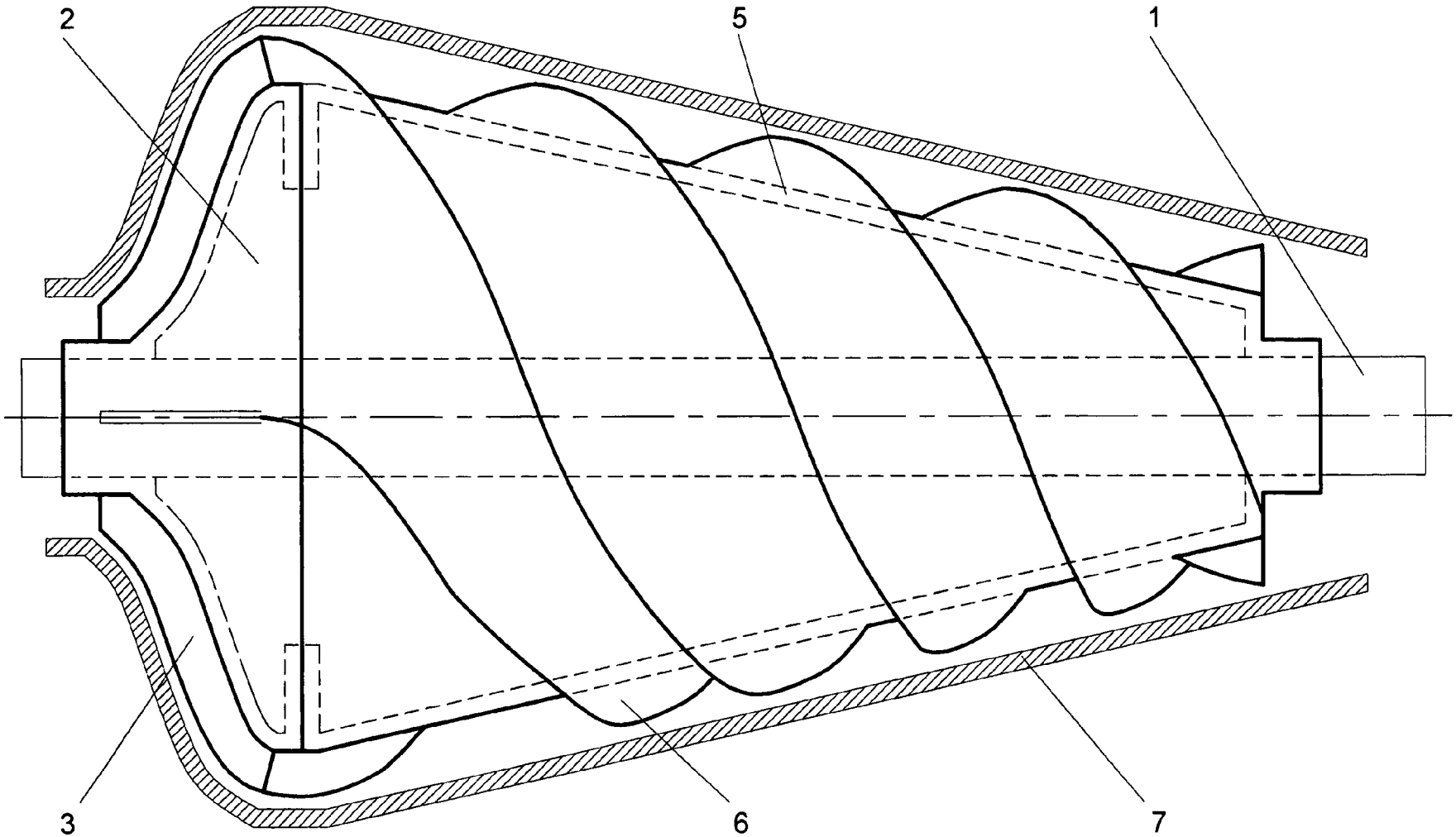
FIG. 1 is a side view of the complete compressor, with the casing cut open.
Figure 2:
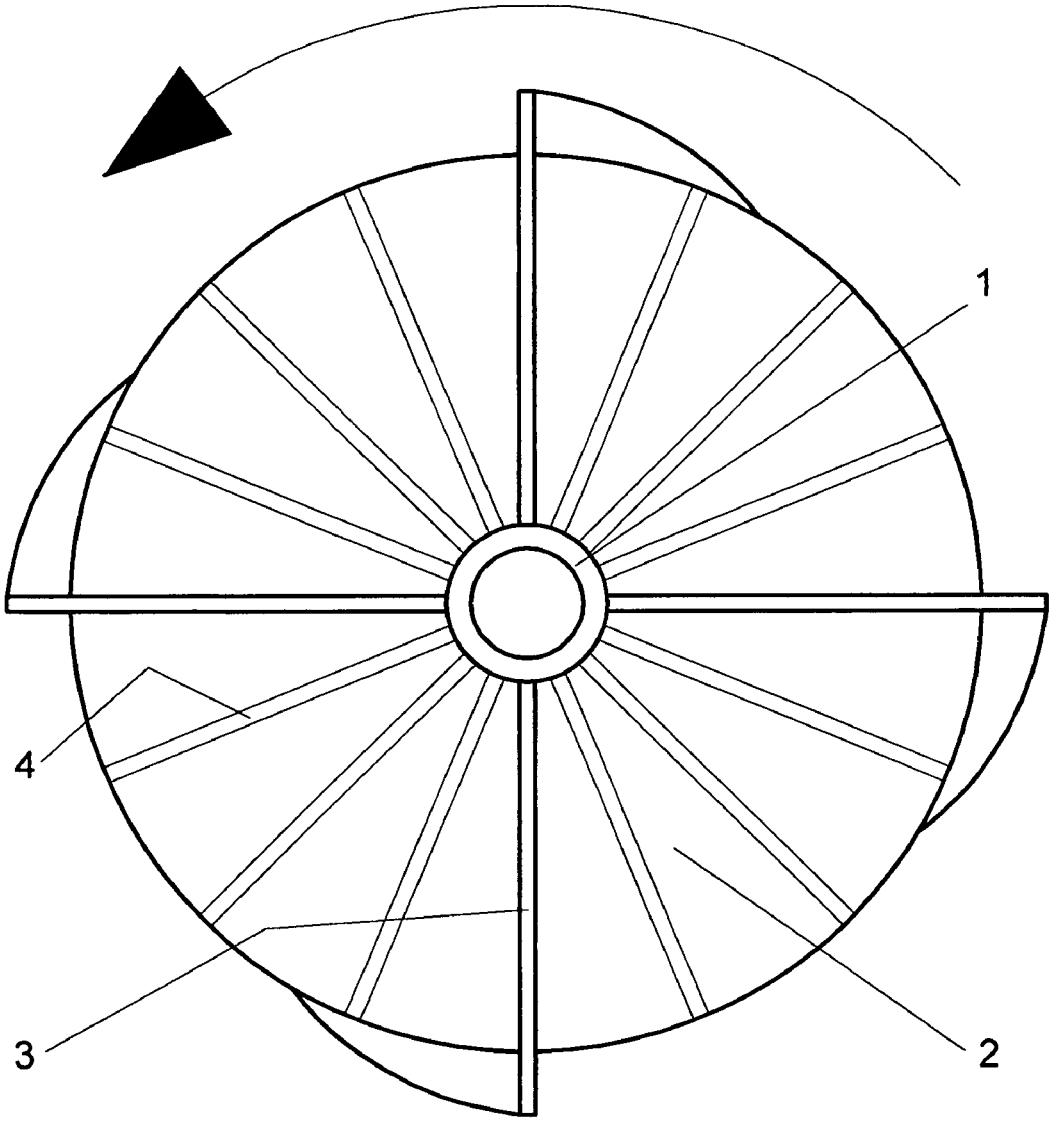
FIG. 2 is a front view of the centrifuge, with no casing.
Figure 3:
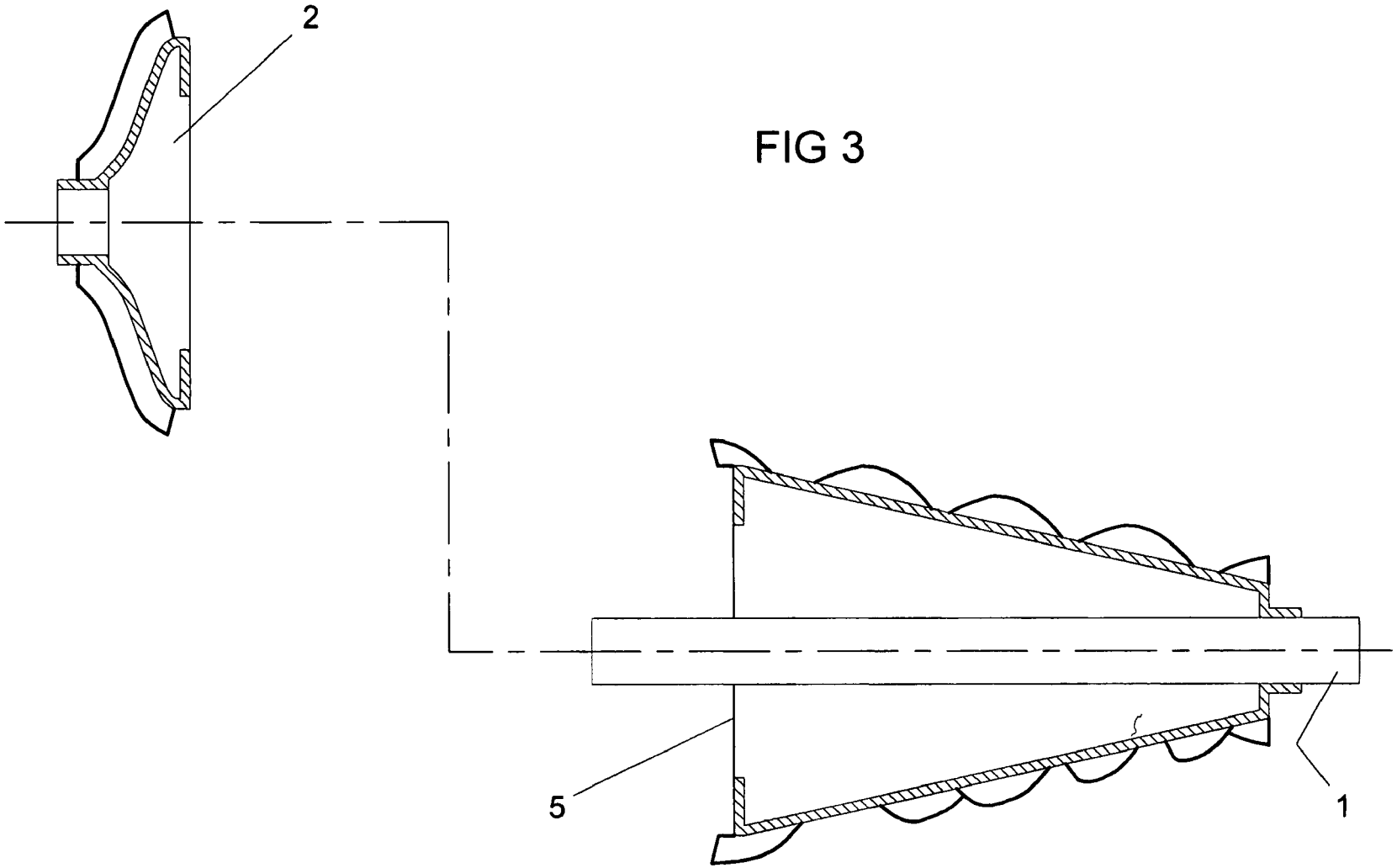
FIG. 3 is an exploded view showing the compressor main parts.

Referring to the drawings there is provided a compound centrifugal and screw compressor comprising two separate sections. The first section is a conventional centrifugal compressor body 2 with a plurality of long radial vanes 3 and short radial vanes 4 on the front face. The second section of the compressor is a screw type compressor with a plurality of helical vanes 6 mounted on a conical screw body 5; the helical vanes 6 are lesser in number than the short radial vanes 4 and the same in number as the long radial vanes 3, being typically one quarter to one third, and mate up with longer radial vanes 3 at the extremity of the centrifugal compressor rim 2. The conical screw body 5 is the same diameter as the outer rim of the centrifugal compressor 2 and reduces down at the output end. The helical vanes 6 each complete one full turn; the compressor is manufactured in two separate parts only, each part being in one piece; the two parts are mounted on a driven shaft 1. The whole compressor is enclosed in a casing 7 with an inlet at the centrifuge 2 end and an exhaust at the smaller end of the screw body 5. The casing ducts the compressed air within. This compressor is suitable for gas turbines, turbochargers, superchargers and the like. See FIGS. 1, 2 and 3.

Figure 4:
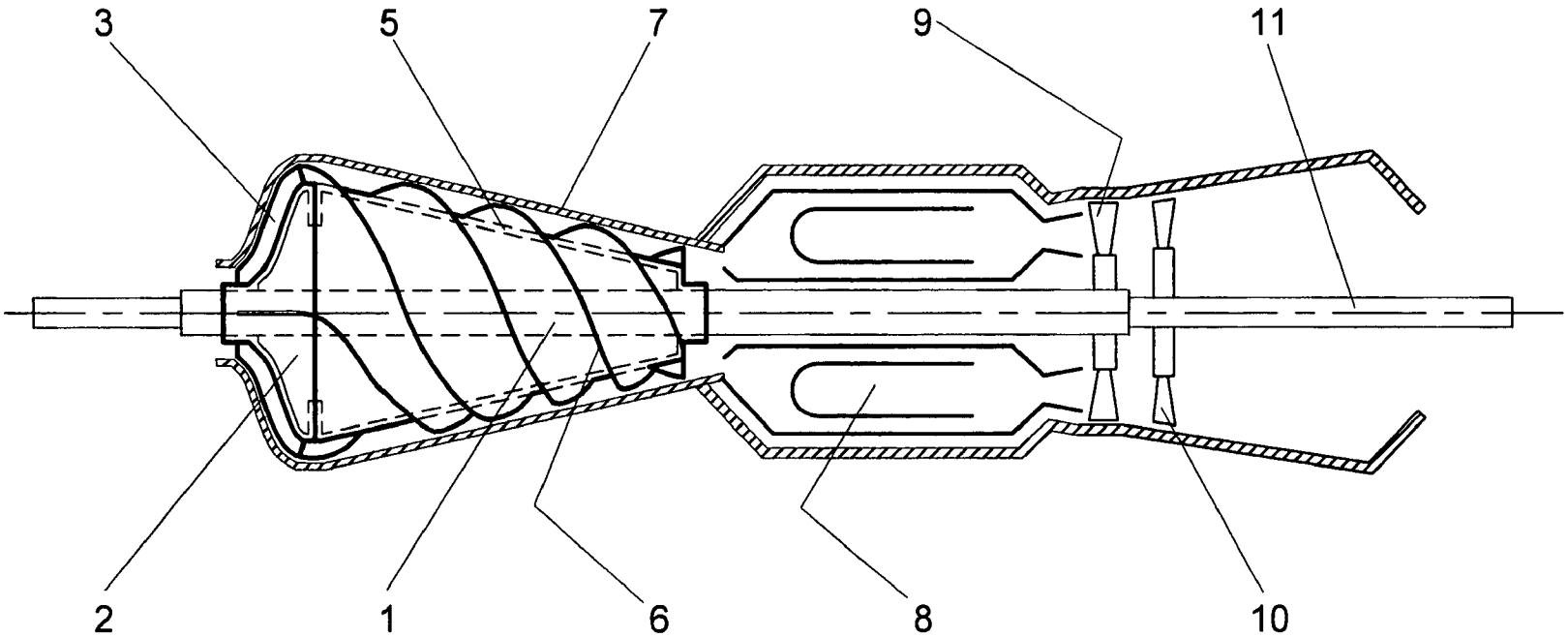
FIG. 4 is a drawing showing the compressor used in a turboshaft application.

Referring to FIG. 4 the compressor is fitted within a turboshaft engine with combustion chambers 8, turbine 9 for driven shaft 1 and a turbine 10 for output shaft 11.

Figure 5:
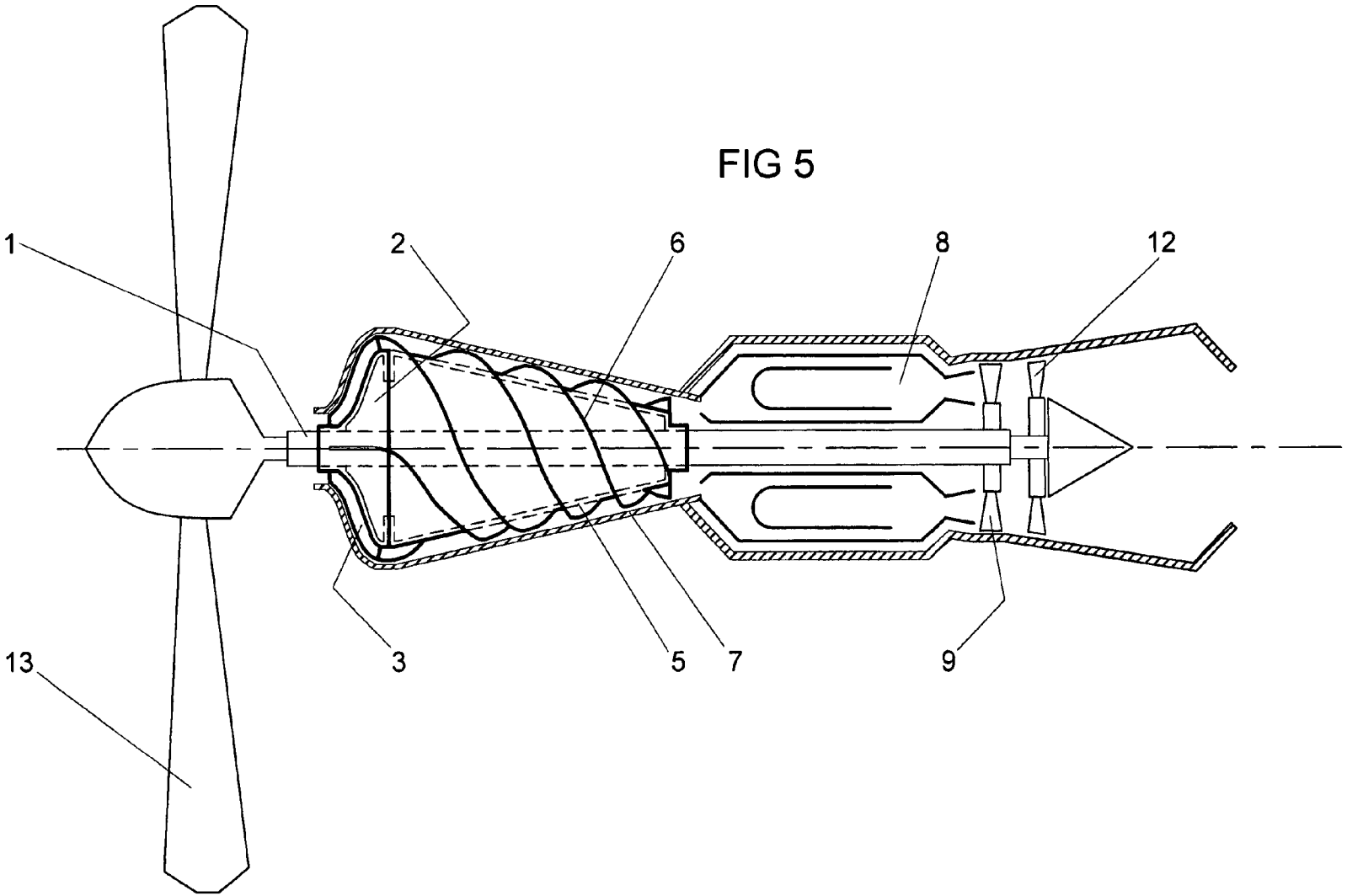
FIG. 5 is a drawing showing the compressor used in a turboprop application.

Referring to FIG. 5 the compressor is fitted within a turboprop engine with combustion chambers 8, turbine 9 for driven shaft 1 and a turbine 12 for propeller 13.

Figure 6:
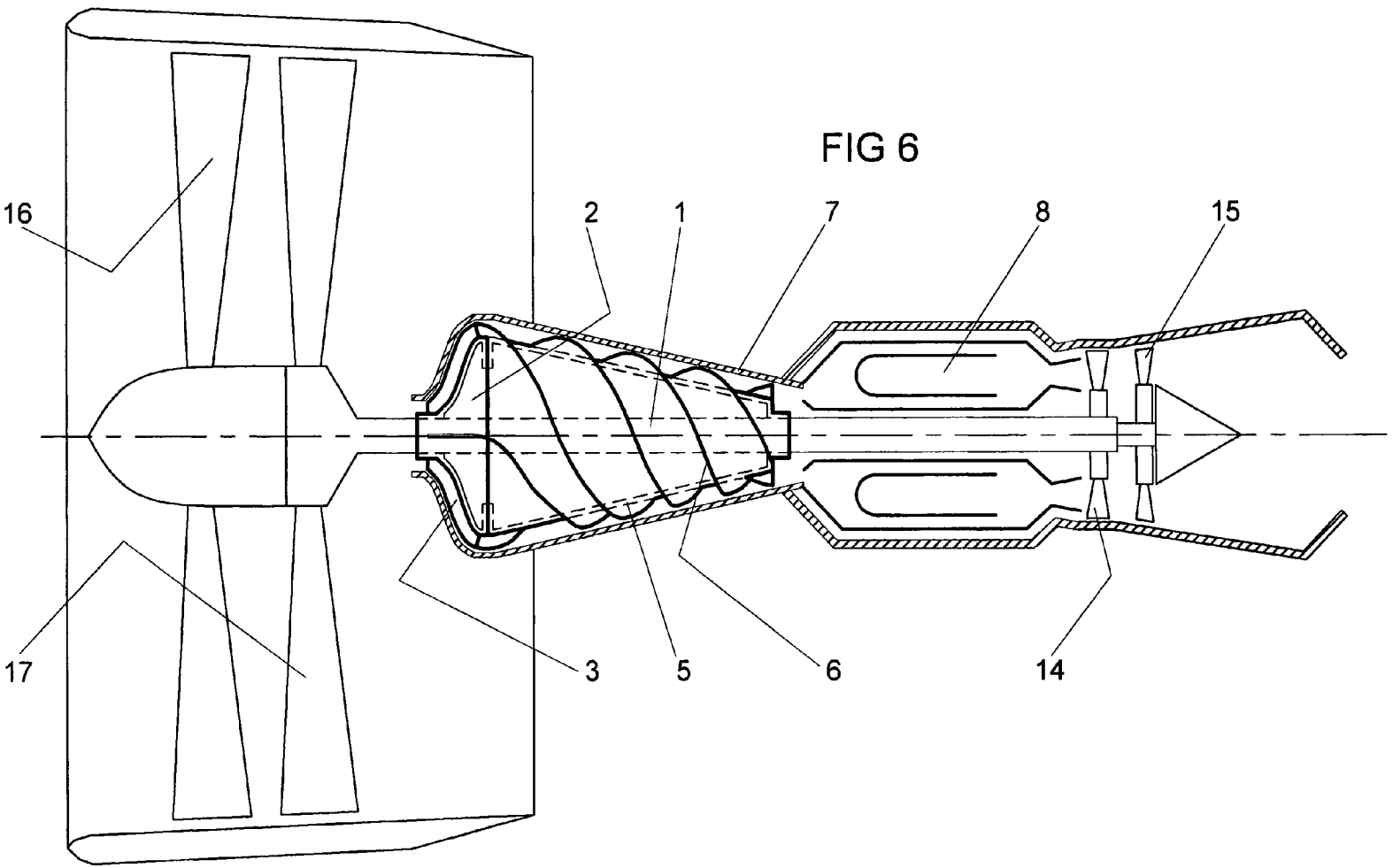
FIG. 6 is a drawing showing the compressor used in a turbofan application.

Referring to FIG. 6 the compressor is fitted within a turbofan engine with combustion chambers 8, turbine 14 for driven shaft 1 and low pressure fan 17; with a turbine 15 for high pressure fan 16.

The compressor has a pressure ratio in the region of 32:1.

What is claimed is:

1. A compound compressor of simple and lightweight construction with a high pressure ratio comprising:

a centrifugal compressor with a plurality of radial vanes on the front face;

some said radial vanes are short radial vanes and finish at the centrifuge rim;

some said radial vanes are long radial vanes and overhang the centrifuge rim;

said long radial vanes are one quarter to one third in number of said short radial vanes;

a conical screw body;

said body mates up to said rim and extends behind said rim further aft;

said body tapers towards the rear;

said body has a plurality of helical vanes;

said vanes are the same in number as said long radial vanes;

said helical vanes mate up with said long radial vanes at the centrifuge rim;

said helical vanes each complete one full turn;

a driven shaft;

said centrifuge and said screw body are complete and separate parts;

said parts form whole compressor;

said compressor fits on to said shaft;

a compressor casing surrounding said parts;

said casing encloses air within.

2. A compound compressor as claimed in claim 1 manufactured as a turboshaft compressor.

3. A compound compressor as claimed in claim 1 manufactured as a turboprop compressor.

4. A compound compressor as claimed in claim 1 manufactured as a turbofan compressor.

* * * * *